US009884352B2

(12) United States Patent
Cooper et al.

(10) Patent No.: US 9,884,352 B2
(45) Date of Patent: Feb. 6, 2018

(54) PIPE CLEANING APPARATUS, USE, SYSTEM, AND METHOD

(75) Inventors: Randall Cooper, Bracebridge (CA); Kevin Lillie, Bracebridge (CA); Dave Marshall, Bracebridge (CA); John Hochfellner, Bracebridge (CA)

(73) Assignee: Envirologics Engineering Inc., Bracebridge, Ontario (CA)

( * ) Notice: Subject to any disclaimer, the term of this patent is extended or adjusted under 35 U.S.C. 154(b) by 326 days.

(21) Appl. No.: 14/356,384

(22) PCT Filed: Feb. 15, 2012

(86) PCT No.: PCT/CA2012/050085

§ 371 (c)(1),
(2), (4) Date: May 5, 2014

(87) PCT Pub. No.: WO2013/120164

PCT Pub. Date: Aug. 22, 2013

(65) Prior Publication Data

US 2014/0299158 A1 Oct. 9, 2014

(51) Int. Cl.

| | |
|---|---|
| ***B08B 9/043*** | (2006.01) |
| ***B08B 9/032*** | (2006.01) |
| ***B08B 9/055*** | (2006.01) |
| *E03B 7/00* | (2006.01) |

(52) U.S. Cl.

CPC ..... *B08B 9/043* (2013.01); *B08B 9/0321* (2013.01); *B08B 9/0551* (2013.01); *E03B 7/006* (2013.01)

(58) Field of Classification Search

CPC ..... B08B 9/0321; B08B 9/0551

See application file for complete search history.

(56) References Cited

U.S. PATENT DOCUMENTS

| | | | | |
|---|---|---|---|---|
| 3,073,687 A | | 1/1963 | McCune | |
| 4,055,025 A | | 10/1977 | Seese et al. | |
| 4,545,426 A | | 10/1985 | Collins | |
| 5,230,842 A | * | 7/1993 | Munde | B08B 9/0553 118/408 |
| 5,444,886 A | * | 8/1995 | Takashina | F16L 55/46 15/104.062 |
| 5,735,016 A | | 4/1998 | Allen et al. | |
| 6,332,930 B1 | * | 12/2001 | Rose | B08B 9/0436 134/8 |

FOREIGN PATENT DOCUMENTS

| | | |
|---|---|---|
| DE | 2047783 A1 | 3/1972 |
| DE | 102004046726 A1 | 5/2005 |

* cited by examiner

*Primary Examiner* — Saeed T Chaudhry
(74) *Attorney, Agent, or Firm* — Andrew W. Chu; Craft Chu PLLC

(57) ABSTRACT

A debris removal method includes at least any one step of varying i) flow, ii) turbulence, and iii) pressure, within a pipe gas stream. Another embodiment is a cleaning system including a viewer to view inside pipe, and a turbulator associated with the viewer, to vary in a gas stream any of flow, pressure, and turbulence.

7 Claims, 9 Drawing Sheets

PIPE CLEANING APPARATUS, USE, SYSTEM, AND METHOD

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to pipe cleaning, and more specifically pipe cleaning with a gas stream.

2. Description of Related Art including Information Disclosed under 37 CFR 1.97 and 37 CFR 1.98.

Transport pipes (especially liquid transport pipes) are known to become infested with many forms of build up, including tubercles in a case of municipal water pipes. The pipes become sclerotic and continually narrow as tubercles build up. Regardless of pipe type (gas/liquid/solid transport), flow eventually occludes with tubercle residue and other build up. Few viable industrial and commercial solutions are available to deal with sclerotic pipes quickly and effectively.

One option is to replace infected pipes, but this is frequently unnecessary, time consuming, impractical in urban areas and established neighborhoods, expensive, and results in an additional problem of waste pipe disposal.

Another option is to accelerate abrasive projectiles (like rocks of progressive caliber) through infected pipes. A pipe is pressurized with a gas stream, and abrasive projectiles are fed into the stream. The streaming projectiles strike and break away protruding tubercle portions, and discharge out of the pipe along with broken tubercles. This option's defects include inability to clean a) smaller tubercle portions and thin residual layers satisfactorily; and b) pipe elbows, bends, and pipe joints satisfactorily. This option does not always leave a properly prepared and dried finish for bonding, making subsequent coating or lining difficult and unsatisfactory.

Certain pipes, over time, can build up corrosion or retain remnants of previous coatings (bitumen, cement), and the like. Normally these patches cannot be fully removed without harsh and corrosive chemicals. Projectile cleaning alone is insufficient to completely remove these remnants.

Other defects exist in the prior art, and are also discussed in U.S. patent application Ser. No. 12/923,201.

SUMMARY OF THE INVENTION

In one embodiment, the present invention is an apparatus comprising a deflection head to fit within and deflect projectiles through a pipe.

In another, it is a system comprising a deflection head, paired tail, and a cable attached to the head (to feed and pull through the pipe).

In yet another, it is a method comprising deflecting streaming projectiles by striking against a deflector within a pipe.

In yet another, it is use of at least any one selected from a group of a deflector, a deflection head with paired tail, and a cabled deflection head with paired tail, for pipe cleaning.

In yet another, it is a debris removal method comprising at least any one step of varying i) flow, ii) turbulence, and iii) pressure, within a pipe gas stream.

In yet another, it is a system comprising a cable. A viewer is connected to the cable, to view inside a pipe. A turbulator is associated with any of the viewer and the cable, to vary in the pipe any of gas stream flow, pressure, and turbulence.

In yet another, it is use of a turbulator for pipe cleaning with a gas stream.

In yet another, it is a debris removal method comprising plunging a pipe gas stream with a piston.

In yet another, it is a leak detection method comprising at least any one step of varying i) flow, ii) turbulence, and iii) pressure, within a pipe gas stream.

In yet another, it is a liquid extraction method comprising at least any one step of varying i) flow, ii) turbulence, and iii) pressure, within a pipe gas stream.

In yet another, it is a debris removal method comprising vacuuming within a pipe gas stream.

In yet another, it is a leak detection method comprising vacuuming within a pipe gas stream.

In yet another, it is a liquid extraction method comprising vacuuming within a pipe gas stream.

In yet another, it is a liquid extraction method comprising plunging a pipe gas stream with a piston.

In yet another, it is a leak detection method comprising plunging a pipe gas stream with a piston.

In yet another, it is a pipe defect detection method comprising at least any one step of varying i) flow, ii) turbulence, and iii) pressure, within a pipe gas stream.

In yet another it is a pipe defect detection method comprising vacuuming within a pipe gas stream.

In still yet another, it is a pipe defect detection method comprising plunging a pipe gas stream with a piston.

DETAILED DESCRIPTION OF THE DRAWINGS

Figure 1:
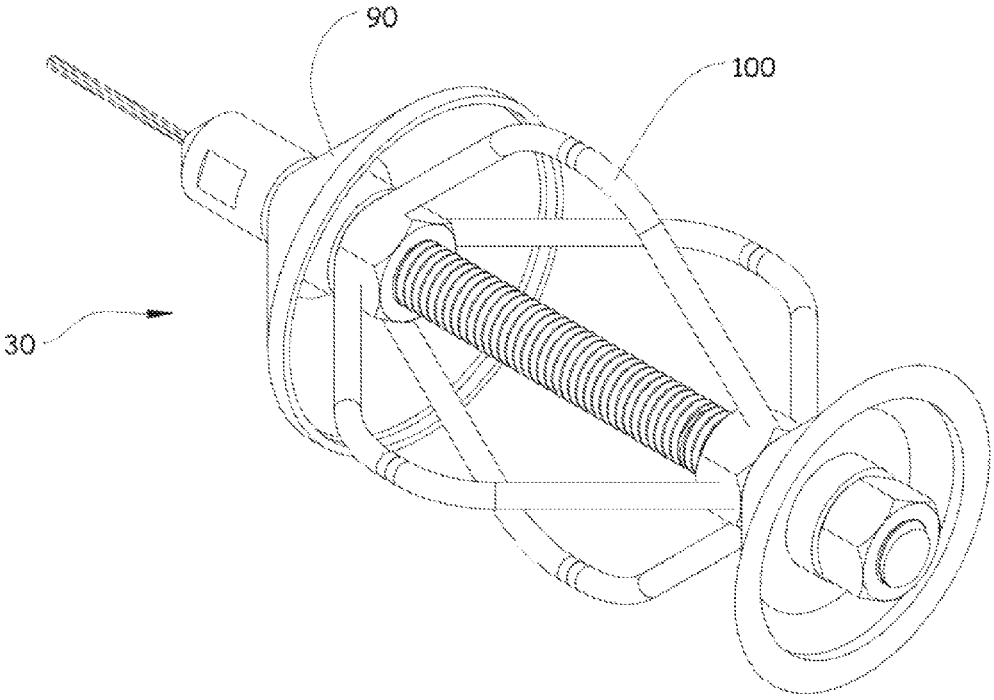
FIG. 1 is a perspective view of a deflector.
Figure 4:
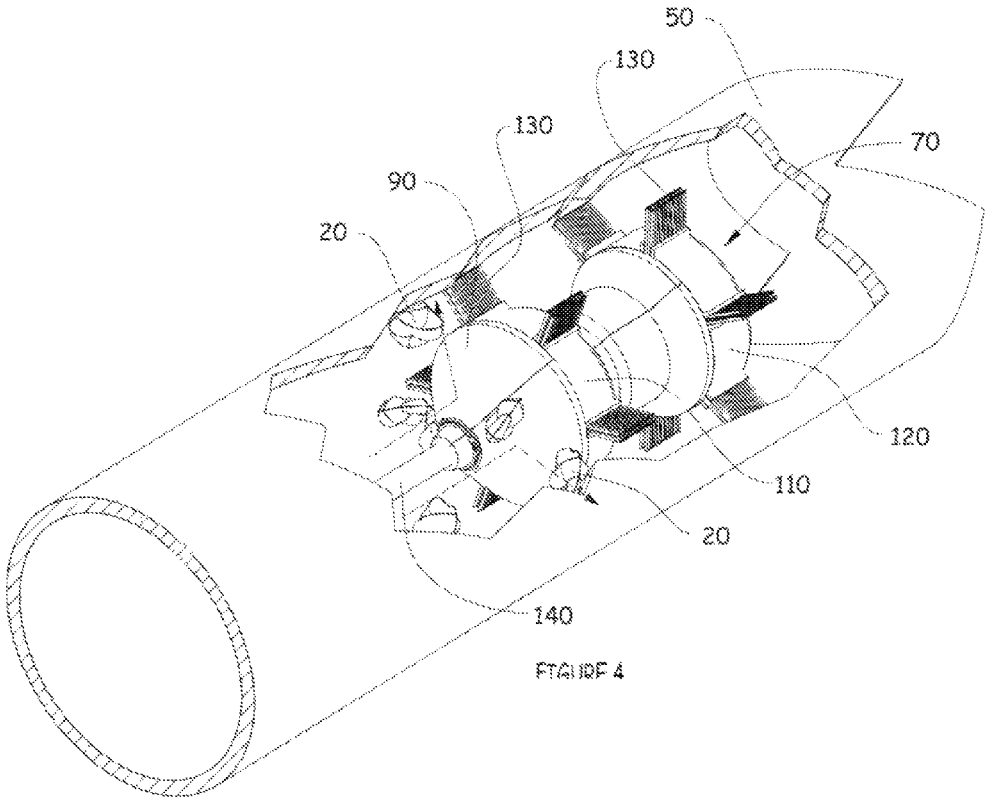
FIG. 4 a sectional view of an alternate embodiment deflector deflecting projectiles pipe.
Figure 5:
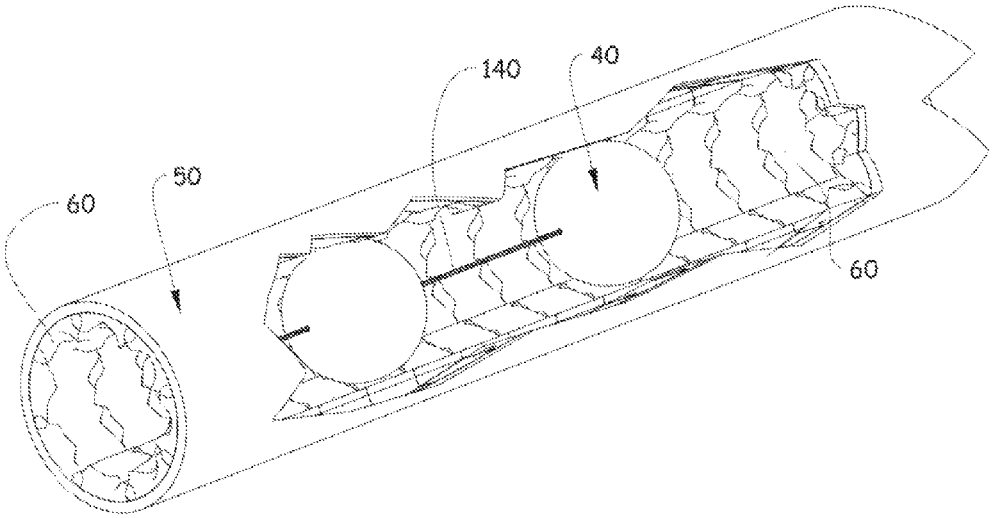
FIG. 5 is a sectional view of an alternate embodiment deflector within a pipe.
Figure 6:
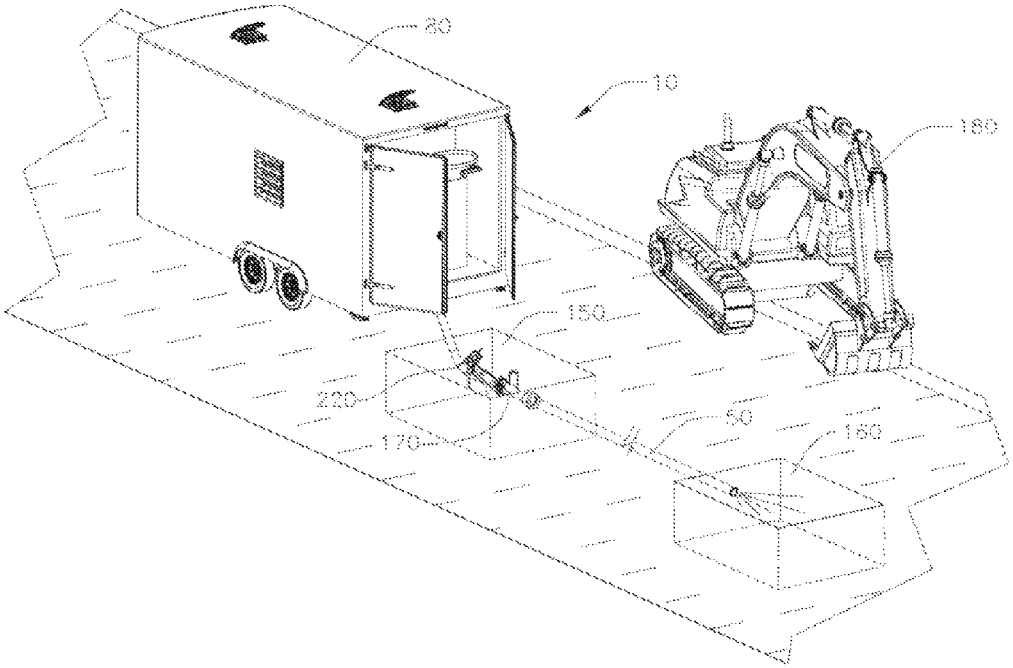
FIG. 6 is a perspective view of a pipe cleaning system and method.
Figure 7:
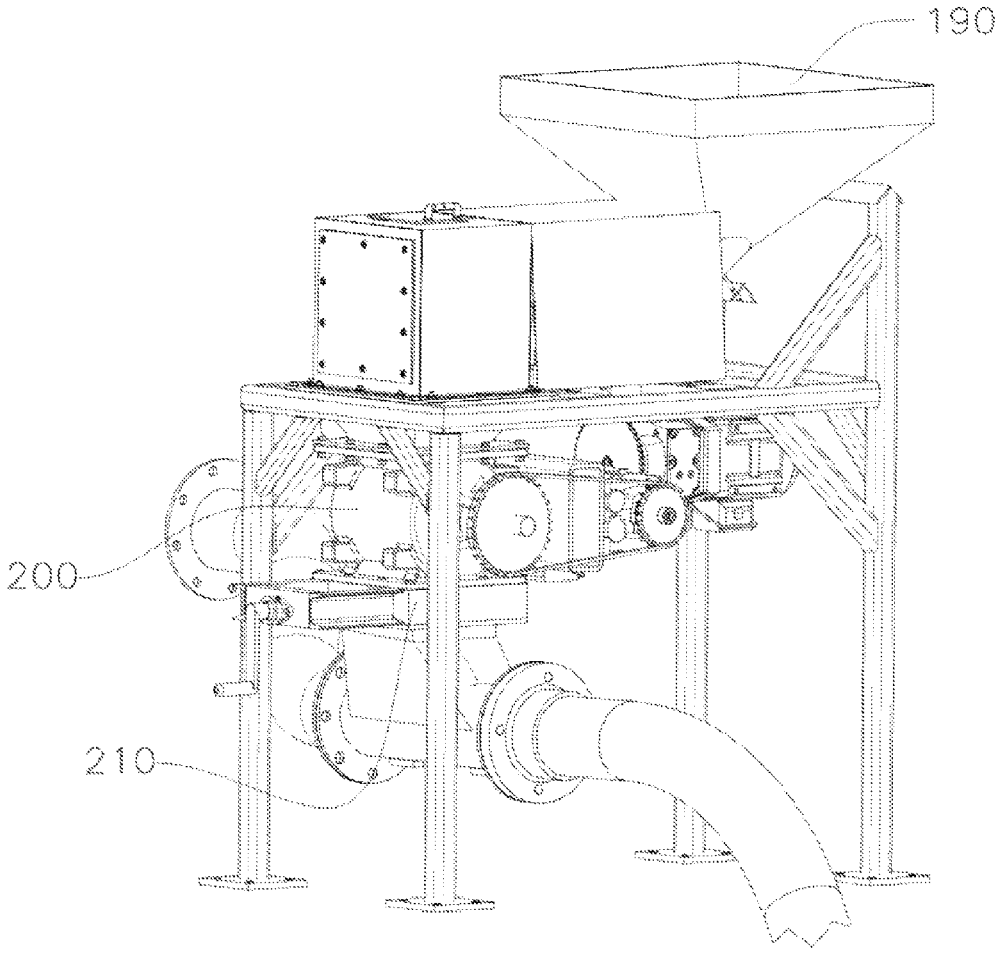
FIG. 7 is a schematic view of a projectile hopper with rotary air lock and gate valve, for dispensing projectiles.

FIG. 6 shows a pipe cleaning system and method (10) generally. The system and method (10) deflects streaming projectiles (20) (FIG. 4) by striking them against a deflector (of which one embodiment is shown in FIG. 1 generally by (30); another in FIG. 5 generally by (40); and still yet another in FIG. 4 generally by (70)) within a pipe (50). It is known to stream projectiles (20) through a pipe (50) to break and remove tubercles (60), but it is not known to use a deflector to increase cleaning effectiveness and speed.

A tubercle (60) is generally a bumpy, rocky, and rigid protuberance, forming wart-like lesion in pipes (50). Tubercles (60) arise from natural atherosclerosis and mineral deposition, pollution, residual matter, and living organisms. Tubercle (60) formation is highly likely when any of solid, liquid, and gas matter is conveyed in pipes (50)

A projectile (20) is an impel capable body for firing into pipes (50), to smash tubercles (60). These include bumpy rocks, smooth rocks, ball bearings, shot, shards, ice, sand, shrapnel, bullets, rounds, and pellets, among others, all of variable calibre, shape, density, and hardness, as required.

In context, streaming means impelling, firing, or propelling (by gas, liquid, magnetic propulsion, or other means). In one embodiment it is preferable to use a pump (80) to stream gas through the pipe (50). In another embodiment it could be a vacuum (not shown) to suck or draw gas through the pipe (50). Tubercles (60) are in that embodiment easier to smash with impelled projectiles (20) when tubercles (60) are dried and hardened. Drying and hardening can be done after a select pipe (50) section is isolated. The pump (80) can be a blower or a compressor of any variation or type.

In one embodiment the deflector (30) has a head (90) that can be described as any of angled, curved, conical, semi-spherical, spherical, oblate, planar, and polyhedral. The head (90) is a deflection surface. Any projectile (20) striking that head (90) will alter course and ricochet (see stippled arrows in FIG. 4).

In one embodiment the deflector (30) additionally has a tail (100) that can be any of long, elaborate, extending, protruding, branched, forking, with arms, containing a tail therein, including an axial shaft, including bolts, angled, curved, conical, oblate, spherical, and polyhedral.

In another embodiment the deflector (70) has a tail (110) that includes a connection neck, a lower disposed skirt (120), and brushes (130).

These tails (100, 110), when present, bias their respective head (90) radially inward the pipe (50) when gas is streamed through the pipe (50). The head (90) becomes a relatively steady and consistent target for controlled projectile (20) ricochet. The head (90) and whichever tail (100, 110) are paired to each other.

The deflectors (30, 40, 70) can be controlled and moved back and forth in a gas stream, to improve cleaning effectiveness (ie more thorough cleaning of particularly tubercle (60) infested pipe (50)). Cleaning effectiveness is important for adhering coating or lining to the pipe (50) after cleaning. The cleaner and drier the pipe (50), the better the coating or lining adheres, and the better protected (from infestation) it is in future use. This is also true when the lining or coating becomes classified as a replacement pipe (50).

Figure 2:
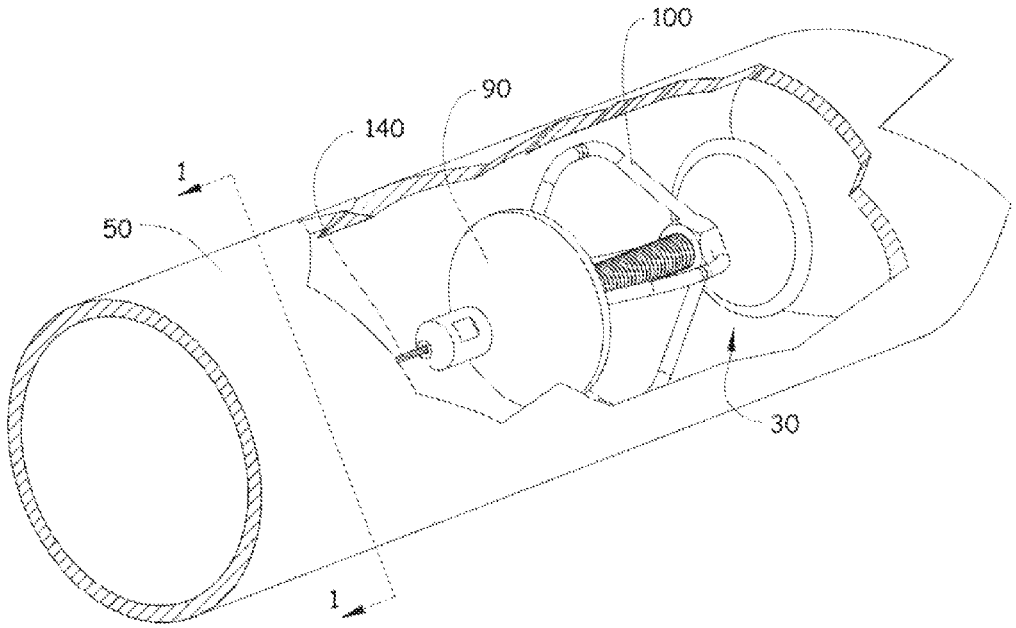
FIG. 2 is a sectional view of a deflector within a pipe.
Figure 3:
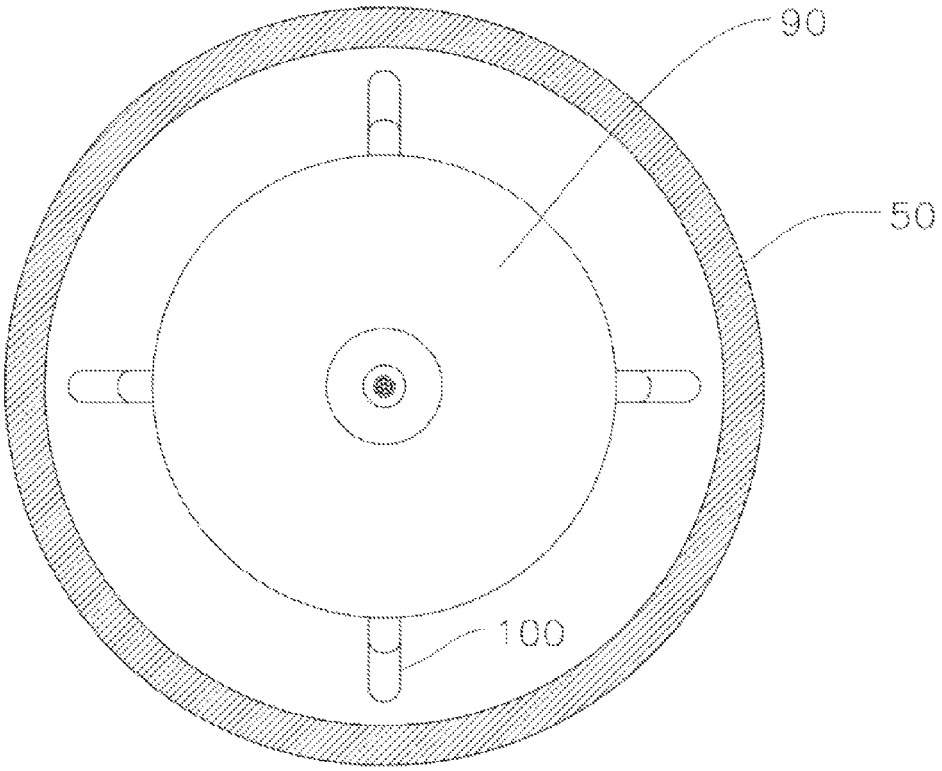
FIG. 3 is a cross-sectional view along the line 1-1 in FIG. 2.

In one embodiment the deflector (30, 40, 70) (as in FIGS. 1, 2, and 4 respectively) is cephalopodic—squid like, with bilateral body symmetry, a prominent head, and branch-like arms).

In one embodiment the deflector (40) head and tail are semi-spherical, together spherical, and integrated into one. The semi-spheres in alternate embodiments need not be together and integrated as one.

A system can be formed by fitting a head (90) with cable (140) (or any other suitable connector e.g. chain link, etc.). Once fitted, the deflector (30), in whichever embodiment it may be, is then suitable for using in pipe (50) cleaning.

The system is scalable by adding at least one more paired head (90) and tail (100) to any preceding paired head (90) and tail (100), in a head to tail configuration.

One method for pipe (50) cleaning requires digging ground to access a pipe (50). Typically, a first (150) and second (160) pit is dug with a shovel (180), and the pipe (50) section of interest is isolated. Any liquid supply to the pipe (50), if present, is terminated. A pump (80) is connected to one end of the pipe (50) in the first pit (150), using a split- or multi-arm pipe (170) connection. The pump (80) streams gas through the pipe (50) to empty the pipe (50) interior, and expose tubercles (60) encrusted therein to gas and projectile (20) flow.

A hopper (190) communicates with the pipe (50) through a pipe connection (170) near the first pit (150). Preferably the hopper (190) permits continuous projectile feeding without ceasing and restarting the gas stream. One such hopper (190) includes a rotary air lock valve (200) and a gate valve (210). Projectiles (20) are loaded into the hopper (190) at atmospheric pressure, or a pressure lower than the pipe (50) pressure when gas is streamed therein. The air lock valve (200) moves a predetermined number of projectiles (20) from the hopper (190) bottom into position for transit past the gate valve (200). On rotation, the air lock (200) transfers projectiles from a lower pressure state to an area set for increased pressure once the gate valve (210) is opened. The increased pressure (from gas streaming, once the valve (210) is opened) impels the projectile (20) forward and through the pipe (50). If the projectiles (20) strike any tubercles (60), the projectiles (20) typically break away some portion of those tubercles (60) for discharge into the second pit (160).

An initial cleaning is performed by impelling enough projectiles (20) through the pipe (50) to create a reasonably consistent bore of a prescribed diameter. During the initial cleaning, intermixed projectiles (20) and tubercles (60) are discharged from the pipe (50) into the second pit (160). When all cleaning is complete, projectile (20) feeding and gas streaming are ceased, and the discharged projectiles (20) and tubercles (60) can be collected and removed for waste disposal.

To improve both cleaning speed and resolution, after the initial cleaning the gas stream and projectile (20) are ceased. A deflector (30) is connected to a cable (140), and the cable (140) is connected to a winch (220) (for feeding and pulling cable (140)). The deflector (30) is fed into a pipe connection (170) housing. The connection (170) houses the deflector (30) until it is ready to be fed into the pipe (50). The gas stream is then reintroduced, to assist in feeding the deflector (30) through the pipe (50) to a desired location. When in position, the projectile (20) feed is reintroduced. The projectiles (20) are impelled forward to strike the deflector (30). The projectiles (20) ricochet thereafter, striking the pipe (50) inner surface. The deflector (30) can be gently fed and pulled by the winch (220), to increase cleaning resolution in a target area. Projectile (20) calibre can be adjusted to increase cleaning resolution and speed. The deflected projectiles (20) clean the pipe (50) interior faster and more thoroughly than by just streaming projectiles (20) through the pipe (50) unobstructed.

When all cleaning is complete, the pipe (50) interior can be coated or lined, to extend pipe (50) life and prevent re-infestation. The pipe (50) thereafter can be reintroduced into its original network and location for service. Liquid supply, if present, can afterward be reintroduced. After the projectiles (20) and tubercles (60) are collected and removed (if required), the pits (150, 160) can be refilled (if required).

In another method, pipe (50) cleaning can be enhanced by removing debris (240), including rocks, pebble, grit, bitumen, tar, and the like. At any appropriate time in a pipe (50) cleaning process, a turbulator can be inserted into the pipe (50) gas stream. The turbulator may be a piston (such as a deflector (40) or camera/viewer (270) attached to cable (140)). When introduced into the gas stream, the deflector (40) surface causes turbulence in the passing stream. The turbulator or piston can be plunged at a specified location to increase debris removal intensity. Increased turbulence displaces debris (240) upward and the stream pushes it forward, and out of the pipe (50). Other tabulators are possible, and turbulence can be created in ways other than plunging with a piston or turbulator. The debris (240) removal can be viewed with a camera (270) to ensure the pipe (50) is properly cleaned.

In yet another method, pipe (50) cleaning can be enhanced to remove debris (240), including rocks, pebble, grit, bitumen, tar, and the like, by varying the gas stream flow properties (stream expansion and contraction). One way of varying the properties of the flow is to introduce a turbulator or piston into the pipe (50). Another way is to introduce selective pipe (50) constrictions, reducing the flow area (like in a Venturi pipe). That stream area reduction (ie flow velocity variance) displaces debris (240) upward and the stream pushes it forward, and out of the pipe (50). Again, the debris (240) removal can be viewed with a camera (270) to ensure thorough cleaning.

In yet another method, pipe (50) cleaning can be enhanced to remove debris (240), including rocks, pebble, grit, bitumen, tar, and the like, by varying the gas stream pressure. One way of varying the pressure is to plunge the pipe (50) with a turbulator or piston. Another way is to introduce selective pipe (50) constrictions, reducing the flow area (like in a Venturi pipe). Yet another is to increase pump (80) force (ie the pressure at which it pumps gas or air). Selective pressure variance at a desired location displaces debris (240) upward and the stream pushes it forward, and out of the pipe (50). A camera/viewer (270) can be used to view the debris (240) removal.

Figure 8:
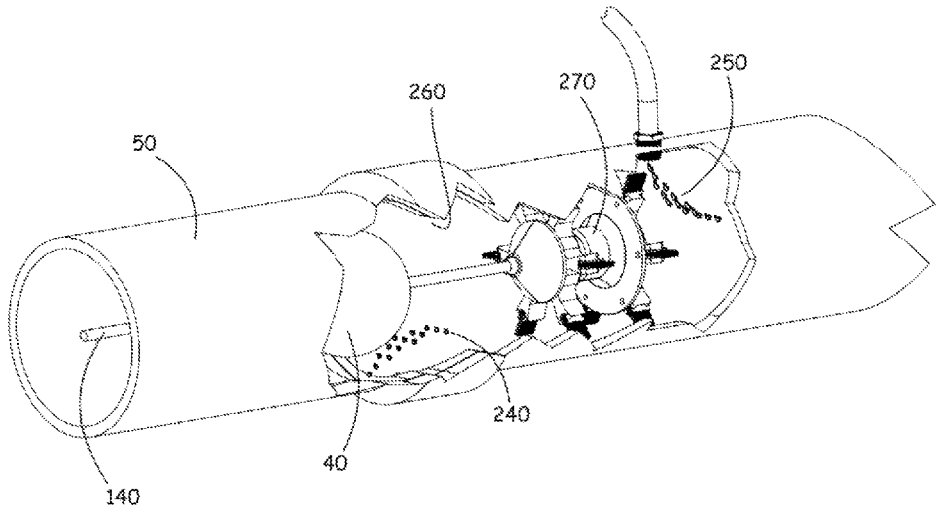
FIG. 8 is a sectional view of a deflector and viewer arrangement removing debris, detecting pipe leaks, and extracting liquid from pipe.
Figure 9:
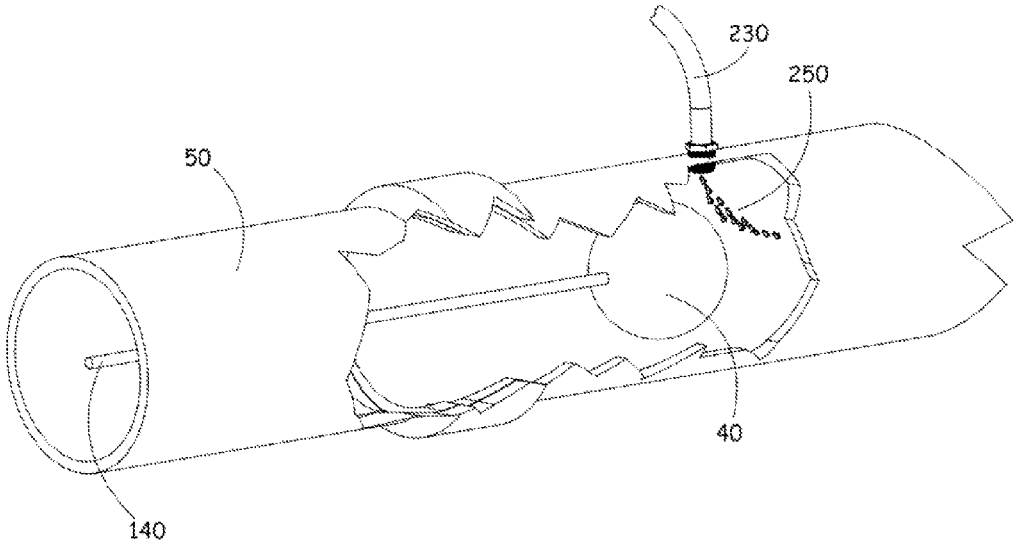
FIG. 9 is a sectional view of a deflector removing debris, detecting pipe leaks, and extracting liquid from pipe.

In another method, pipe (50) leaks can be detected near any of service connections (230), pipe elbows (not shown) and pipe joints (260). At any appropriate time in a pipe (50) cleaning process, a turbulator or piston can be inserted into the pipe (50) gas stream. The turbulator or piston can be plunged at a specified location, and that plunging causes any liquid (250) that would otherwise slowly leak into the pipe (50) (but not be consistently visible), to be forceably and immediately drawn into the pipe (50). The increased stream turbulence draws liquid (250) from cracks, and exposes any pipe (50) leaks. Leak detection can be visually confirmed by using a camera (270) to view any liquid (250) seepage (FIG. 8). This same step can also be used to extract liquid (250) from the leak site, and draw it out the pipe (50) altogether, making both detection and extraction possible. The increased turbulence pulls liquid (250) along the pipe (50) during extraction, helping to more quickly and thoroughly dry the pipe (50) for subsequent coating or lining.

In another method, pipe (50) leaks can be detected near any of service connections (230), pipe elbows (not shown) and pipe joints (260), by varying the gas stream flow (stream expansion and contraction). One way of varying the flow is to plunge the pipe (50) with a turbulator or piston. Another way is to introduce selective pipe (50) constrictions, reducing the flow area (like in a Venturi pipe). That selective flow variance causes any liquid (250) that would otherwise slowly leak into the pipe (50) (but that may not be consistently visible), to be forceably and immediately drawn into the pipe (50). The stream expansion and contraction draws liquid (250) from cracks, and exposes any pipe (50) leaks. Leak detection can be visually confirmed by using a camera (270) to view any liquid (250) seepage. This same step can also be used to extract liquid (250) from the leak site, and draw it out the pipe (50) altogether, making both detection and extraction possible. The stream expansion and contraction pulls liquid (250) along the pipe (50) during extraction, helping to more quickly and thoroughly dry the pipe (50) for subsequent coating or lining.

In another method, pipe (50) leaks can be detected near any of service connections (230), pipe elbows (not shown) and pipe joints (260), by varying the gas stream pressure. One way of varying the pressure is to plunge the pipe (50) with a turbulator or piston. Another way is to introduce selective pipe (50) constrictions, reducing the flow area (like in a Venturi pipe). Yet another is to increase pump (80) force (ie the pressure at which it pumps gas or air). Selective pressure variance causes any liquid (250) that would otherwise slowly leak into the pipe (50) (but that may not be consistently visible), to be forceably and immediately drawn into the pipe (50). The pressure variance draws liquid (250) from cracks, and exposes any pipe (50) leaks. Leak detection can be visually confirmed by using a camera (270) to view any liquid (250) seepage. This method can also be used to extract liquid (250) from the leak, and draw it out the pipe (50) altogether, making both detection and extraction possible. The stream pressure variance pulls liquid (250) along the pipe (50) during extraction, helping to more thoroughly dry the pipe (50) for subsequent coating or lining.

In yet another method debris (240) can be vacuumed out of the pipe (50), for improved cleaning. One way of creating a vacuum is to plunge a piston at a specified location, which in turn creates a localized and controllable vacuum. The vacuum displaces debris (240) upward and the stream pushes it forward, and out of the pipe (50). A localized vacuum can be created in other ways. The debris (240) removal can be viewed with a camera (270) to ensure the pipe (50) is properly cleaned.

In yet another method, pipe (50) leaks can be detected near any of service connections (230), pipe elbows (not shown) and pipe joints (260), by localized pipe (50) vacuuming. One way of creating a vacuum is to introduce (and optionally) plunge a piston at a specified location. Another way is to introduce selective pipe (50) constrictions, reducing the flow area (like in a Venturi pipe). Selective localized vacuuming causes any liquid (250) that would otherwise slowly leak into the pipe (50) (but that may not be consistently visible), to be forceably and immediately drawn into the pipe (50). The vacuum draws liquid (250) from cracks, and exposes any pipe (50) leaks. Leak detection can be visually confirmed by using a camera (270) to view any liquid (250) seepage. This method can also be used to extract liquid (250) from the leak, and draw it out the pipe (50) altogether, making both detection and extraction possible. The vacuuming displaces the liquid (250), and the stream pulls the liquid (250) along the pipe (50) during extraction, helping to more quickly and thoroughly dry the pipe (50) for subsequent coating or lining.

Apart from the above, a camera (270) (or other kind of viewer) can be used to view many of the other method steps disclosed herein.

In another method, pipe (50) defects (like cracks, fractures, and holes) can be detected, enabling condition assessment of the pipe (50). At any appropriate time in a pipe (50) cleaning process, a tabulator or piston can be inserted into the pipe (50) gas stream near a suspected crack, fracture, or hole. The turbulator or piston can also be plunged at that specified location. That insertion or plunging causes any liquid (250) or debris (240) inside that crack, fracture, or hole, to be drawn into the pipe (50), thereby exposing that defect. The defect detection can be visually confirmed by using a camera (270) to view that drawing of liquid (250) or debris. The increased turbulence pulls liquid (250) and debris (240) along the pipe (50) during extraction, helping to more quickly and thoroughly clean and dry the pipe (50) for subsequent coating or lining.

In another method, pipe (50) defects (like cracks, fractures, and holes) can be detected, by varying the gas stream flow properties (stream expansion and contraction). One way of varying the flow properties is to introduce (and optionally) plunge the pipe (50) with a turbulator or piston. Another way is to introduce selective pipe (50) constrictions, reducing the flow area (like in a Venturi pipe). That selective flow variance causes any liquid (250) or debris (240) inside that crack, fracture, or hole, to be drawn into the pipe (50), thereby exposing that defect. The defect detection can be visually confirmed by using a camera (270) to view that drawing of liquid (250) or debris (240). The stream expansion and contraction displaces liquid (250) and debris (240) into the air stream, which pushes it forward along the pipe (50) during extraction, helping to more quickly and thoroughly clean and dry the pipe (50) for subsequent coating or lining.

In another method, pipe (50) defects (like cracks, fractures, and holes) can be detected, by varying the gas stream pressure. One way of varying the pressure is to introduce (and optionally) plunge the pipe (50) with a turbulator or piston. Another way is to introduce selective pipe (50) constrictions, reducing the flow area (like in a Venturi pipe). Yet another is to increase pump (80) force (ie the pressure at which it pumps gas or air). Selective pressure variance causes any liquid (250) or debris (240) inside that crack, fracture, or hole, to be drawn into the pipe (50), thereby exposing that defect. The defect detection can be visually confirmed by using a camera (270) to view that drawing of liquid (250) or debris. The stream pressure variance displaces liquid (250) and debris (240) into the air stream, which pushes it forward along the pipe (50) during extraction, helping to more thoroughly clean and dry the pipe (50) for subsequent coating or lining.

In yet another method pipe (50) defects (like cracks, fractures, and holes) can be detected by vacuuming the pipe (50). One way of creating a vacuum is to introduce (and optionally) plunge a piston at a specified location, which in turn creates a localized and controllable vacuum. When near a defect, the vacuum displaces debris (240) upward and the stream pushes it forward, and out of the pipe (50). A localized vacuum can be created in other ways. The defect detection can be viewed with a camera (270) to ensure the pipe (50) is properly cleaned.

We claim:

1. A loose debris and moisture removal method, comprising the steps of:

establishing a pipe gas stream along a length of a pipe;

inserting a turbulator attached to a cable within said pipe gas stream;

setting said turbulator at a first specified location within said pipe, said first specified location being proximal to at least one of a group consisting of a service connection, a pipe elbow, a pipe joint, and a pipe defect, said pipe defect being selected from a group consisting of a crack, fracture, and hole;

actuating said turbulator back and forth by pulling and feeding said cable between said first specified location and a second specified location within said pipe so as to create a localized turbulent lower pressure zone, said at least one of a group consisting of a service connection, a pipe elbow, a pipe joint, and a pipe defect being between said first specified location and said second specified location, said first specified location and said second specified location being between ends of said pipe, wherein said first specified location is not at either end of said pipe, and wherein said second specification location is not at either end of said pipe, and wherein said pipe gas stream passes said turbulator during the step of actuating said turbulator; and pulling debris and liquid from said at least one of a group consisting of a service connection, a pipe elbow, a pipe joint, and a pipe defect along said pipe, with said localized turbulent lower pressure zone.

2. The method in claim 1, further comprising the step of: viewing the step of actuating said turbulator through a camera.

3. The method in claim 1, further comprising the step of: removing said turbulator from said pipe before said turbulator reaches an end of said pipe.

4. A method of loose debris and moisture removal, said method comprising the steps of:

inserting a turbulator attached to a cable within a pipe gas stream in a pipe at a first specified location, said first specified location being proximal to at least one of a group consisting of a service connection, a pipe elbow, a pipe joint, and a pipe defect, said pipe defect being selected from a group consisting of a crack, fracture, and hole;

actuating said turbulator back and forth by pulling and feeding said cable between said first specified location and a second specified location within said pipe so as to create a localized turbulent lower pressure zone, said at least one of a group consisting of a service connection, a pipe elbow, a pipe joint, and a pipe defect being between said first specified location and said second specified location, said first specified location and said second specified location being between ends of said pipe, said pipe gas stream passing said turbulator during the step of actuating said turbulator; and pulling debris and liquid from said at least one of a group consisting of a service connection, a pipe elbow, a pipe joint, and a pipe defect, and with said localized turbulent lower pressure zone.

5. A loose debris and moisture removal method, comprising the steps of:

establishing a pipe gas stream along a length of a pipe;

inserting a turbulator attached to a cable within said pipe gas stream;

setting said turbulator at a first specified location within said pipe, said first specified location being proximal to at least one of a group consisting of a service connection, a pipe elbow, a pipe joint, and a pipe defect, said pipe defect being selected from a group consisting of a crack, fracture, and hole;

actuating said turbulator back and forth by pulling and feeding said cable between said first specified location and a second specified location within said pipe so as to create a localized turbulent lower pressure zone, said at least one of a group consisting of a service connection, a pipe elbow, a pipe joint, and a pipe defect being between said first specified location and said second specified location, said first specified location and said second specified location being between ends of said pipe, wherein said first specified location is separate and distinct from either end of said pipe, and wherein said second specification location is separate and distinct from said first specification location and either end of said pipe, and wherein said pipe gas stream passes said turbulator during the step of actuating said turbulator; and pulling debris and liquid from said at least one of a group consisting of a service connection, a pipe elbow, a pipe joint, and a pipe defect along said pipe, with said localized turbulent lower pressure zone.

6. The method in claim 5, further comprising the step of: viewing the step of actuating said turbulator through a camera.

7. The method in claim 5, further comprising the step of: removing said turbulator from said pipe before said turbulator reaches an end of said pipe.

* * * * *